US009423211B2

(12) United States Patent
Ho

(10) Patent No.: US 9,423,211 B2
(45) Date of Patent: Aug. 23, 2016

(54) LOCKING CONTAINER FOR FIREARMS

(71) Applicant: Francis Ho, Shenzhen (CN)

(72) Inventor: Francis Ho, Shenzhen (CN)

(73) Assignee: TRUCKVAULT, Inc., Sedro Woolley, WA (US)

( * ) Notice: Subject to any disclaimer, the term of this patent is extended or adjusted under 35 U.S.C. 154(b) by 0 days.

(21) Appl. No.: 14/531,793

(22) Filed: Nov. 3, 2014

(65) Prior Publication Data

US 2016/0123701 A1 May 5, 2016

(51) Int. Cl.

| | |
|---|---|
| ***F41C 33/06*** | (2006.01) |
| ***E05B 65/52*** | (2006.01) |
| ***E05G 1/00*** | (2006.01) |
| ***E05C 9/02*** | (2006.01) |

(52) U.S. Cl.

CPC ..... *F41C 33/06* (2013.01); *E05B 65/52* (2013.01); *E05C 9/02* (2013.01); *E05G 1/005* (2013.01); *Y10T 70/5031* (2015.04); *Y10T 70/7107* (2015.04)

(58) Field of Classification Search

CPC .... F41C 33/06; F41C 33/0263; E05G 1/005; E05G 1/02; E05G 1/026; Y10T 70/5031; Y10T 70/7107; Y10T 70/7147; E05C 9/02; E05B 65/52

USPC ..... 70/63, 158–162; 109/45, 50–52; 292/140, DIG. 37

See application file for complete search history.

(56) References Cited

U.S. PATENT DOCUMENTS

| | | | | |
|---|---|---|---|---|
| 3,590,614 | A * | 7/1971 | Kunst | 70/238 |
| 4,309,065 | A * | 1/1982 | Pappas | 312/242 |
| 4,640,110 | A * | 2/1987 | Fish et al. | 70/269 |
| 4,651,544 | A * | 3/1987 | Hungerford | 70/63 |
| 4,688,023 | A * | 8/1987 | McGill et al. | 340/545.6 |
| 4,768,021 | A * | 8/1988 | Ferraro | 340/568.1 |
| 4,854,145 | A * | 8/1989 | Arai et al. | 70/250 |
| 4,866,958 | A * | 9/1989 | Bretl et al. | 70/25 |
| 5,111,755 | A * | 5/1992 | Rouse | 109/25 |
| 5,118,175 | A * | 6/1992 | Costello | 312/242 |
| 5,161,396 | A * | 11/1992 | Loeff | 70/63 |
| 5,172,575 | A * | 12/1992 | Fisher | 70/63 |
| 5,236,086 | A * | 8/1993 | MacTaggart | 206/317 |
| 5,329,865 | A * | 7/1994 | McWard | 109/50 |
| 5,528,998 | A * | 6/1996 | Smith | 109/50 |
| 5,826,715 | A * | 10/1998 | Thompson | 206/261 |
| 5,875,948 | A * | 3/1999 | Sadler | 224/404 |
| 5,881,584 | A * | 3/1999 | Brunoski et al. | 70/68 |
| 5,987,941 | A * | 11/1999 | Zocco | 70/63 |
| 6,260,300 | B1 * | 7/2001 | Klebes et al. | 42/70.11 |
| 6,318,134 | B1 * | 11/2001 | Mossberg et al. | 70/63 |
| 6,564,602 | B2 * | 5/2003 | Gregory | 70/360 |
| 6,581,422 | B1 * | 6/2003 | Chang | 70/70 |
| 6,755,449 | B2 * | 6/2004 | Weinerman et al. | 292/198 |

(Continued)

*Primary Examiner* — Suzanne Barrett
(74) *Attorney, Agent, or Firm* — Jensen & Puntigam P.S.

(57) ABSTRACT

The apparatus includes a body portion and a door removably connected to the body portion, revealing the interior of the body portion, the door having at least one latching element. An access assembly is attached to the body portion, the access assembly including a latch bar having an opening to receive the latching element. A plurality of actuating buttons are provided for the user. A mechanism responsive to operation of preselected buttons in a preselected sequence releases an actuation mechanism. An operating member accessible to the user and operatively connected to the actuation mechanism moves the released actuation mechanism to move the latching bar so that the latching element is released from the latching bar, allowing the door to be opened.

9 Claims, 8 Drawing Sheets

(56) References Cited

U.S. PATENT DOCUMENTS

| | | | | |
|---|---|---|---|---|
| 6,843,081 | B1 * | 1/2005 | Painter | 70/63 |
| 6,895,789 | B2 * | 5/2005 | Masseth et al. | 70/63 |
| 7,086,258 | B2 * | 8/2006 | Fisher et al. | 70/278.7 |
| 7,347,460 | B2 * | 3/2008 | Ala | 292/216 |
| 7,516,632 | B2 * | 4/2009 | Poppell | 70/279.1 |
| 7,546,920 | B1 * | 6/2009 | Horn et al. | 206/317 |
| 7,832,239 | B2 * | 11/2010 | Kozuka et al. | 70/162 |
| 8,196,972 | B2 * | 6/2012 | Lutzke | 292/140 |
| 8,375,751 | B2 * | 2/2013 | Hacker | 70/63 |
| 8,375,752 | B2 * | 2/2013 | Chang et al. | 70/63 |
| 8,695,385 | B2 * | 4/2014 | Meekma et al. | 70/63 |
| 8,905,278 | B2 * | 12/2014 | Elliot et al. | 224/328 |
| 2004/0083778 | A1 * | 5/2004 | Loeff et al. | 70/63 |
| 2005/0200482 | A1 * | 9/2005 | Kurple et al. | 340/545.7 |

* cited by examiner

LOCKING CONTAINER FOR FIREARMS

TECHNICAL FIELD

This invention concerns a container for firearms such as handguns and shotguns and more specifically concerns the mechanism for unlocking a door portion of the container, providing access to the firearms.

BACKGROUND OF THE INVENTION

It is well recognized that it is important to control physical access to weapons, in particular firearms such as handguns and shotguns, especially in a home environment. An owner of firearms will want to have fast and convenient access to a firearm for various reasons, but will also want to prevent access to the firearm by others, particularly children, and/or anyone else, without permission. There are many articles, typically known as gun safes, which are useful for this purpose. However, it is important for the firearm owner to have access to the firearm in a manner which is both convenient and fast.

Accordingly, a firearm container which provides reliable and fast access to a firearm is desirable.

SUMMARY OF THE INVENTION

Accordingly, an apparatus for holding firearms, comprises: a container which includes a body portion for holding a firearm and a door movably connected to the body portion, the door having at least one latching element; and a locking mechanism attached to the body portion, the locking mechanism including a latch bar having at least one latch opening to receive the latch element on the door in a connecting relationship; an actuation mechanism which in operation locks the latch bar relative to the latching element, preventing the door from opening; a plurality of actuating elements on the container for operation by a user; a mechanism responsive to operation of the actuating elements to release the actuation mechanism; and an operating member accessible to the user and connected to the actuation mechanism for moving the actuation mechanism, which in turn moves the latch bar sufficiently that the latch opening is so positioned that the latch element is free to move through the opening, allowing the door to be opened.

BEST MODE FOR CARRYING OUT THE INVENTION

Figure 1:
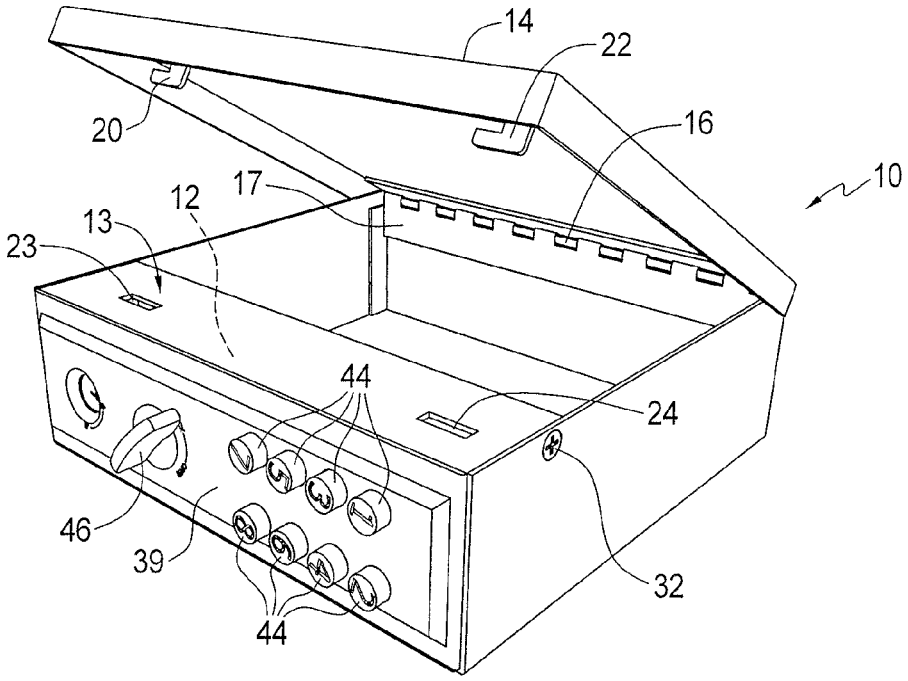
FIG. 1 is a perspective view of a firearm container having a mechanical access structure.
Figure 2:
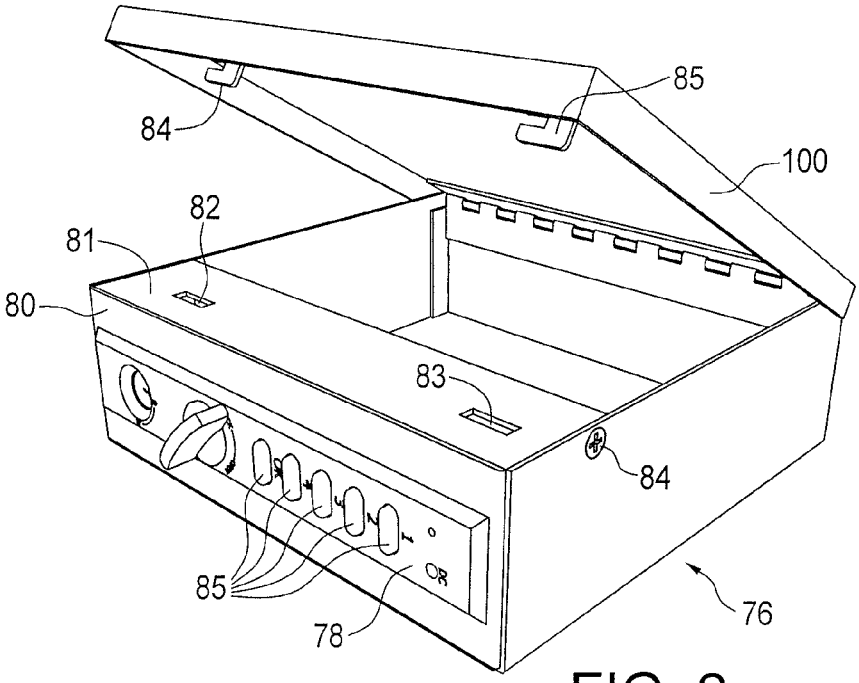
FIG. 2 is a perspective view of an electronically controlled firearm container for handguns which has an electronic control access.

FIG. 1 shows a firearm container or safe, generally at 10, with a mechanical access assembly 12 (shown in detail in FIG. 3) which is covered by a generally L-shaped plate 13. Generally the container is slightly rectangular with a door 14 which is hinged at 16 to one side 12 of the container to permit access to the interior of the container. The container is durable and strong, made from high strength steel or similar material. The door includes two latch members 20 and 22 which fit into mating slots in the mechanical access assembly, through openings 23 and 24 in plate 13. The mechanical access assembly 12 is shown in an exploded view in FIG. 3. The access assembly includes an elongated latching bar 24 which extends for nearly the entire length of the access assembly, leaving a small distance, approximately ½ inch or so, for movement, the latching bar including latch catch openings 26 and 27. The L-shaped plate 13 (FIG. 1) covers the top and rear of the mechanical access assembly and is held in place by two screws 32 on opposite sides of the container. When L-shaped plate 13 is removed, the mechanical access assembly is revealed, shown in FIG. 3, including the latching bar 24. The latching bar is held in place by small bolts which extend from the inner surface of front plate 29, through a first portion 31 of the latching bar, and associated nuts which secure the latching bar, while permitting some side-to-side movement, as explained below. An intermediate portion 34 of the latching bar includes a slot 36 through which an extended arm portion 38 of activation element 40 extends. A third portion 37 of the latching bar includes the two latch openings 26 and 27 through which the latches 20 and 22 from the door extend.

Figure 3:
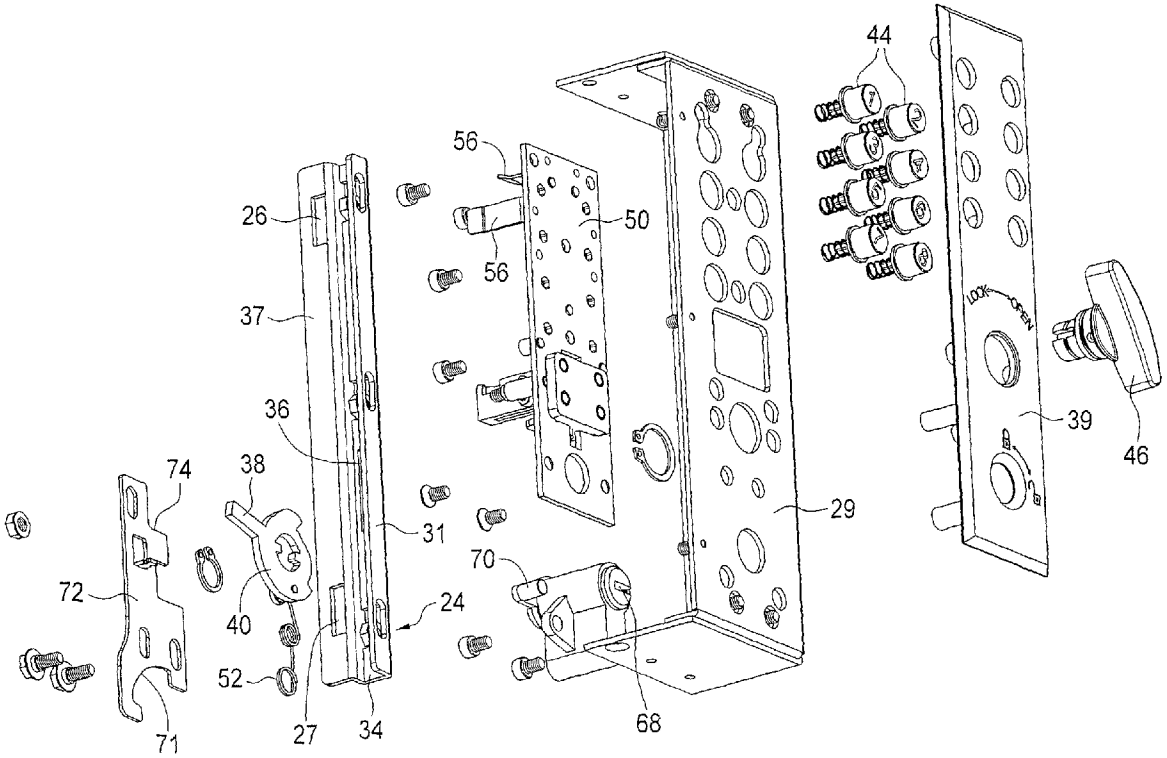
FIG. 3 is an exploded view of the mechanical arrangement of the FIG. 1.
Figure 4:
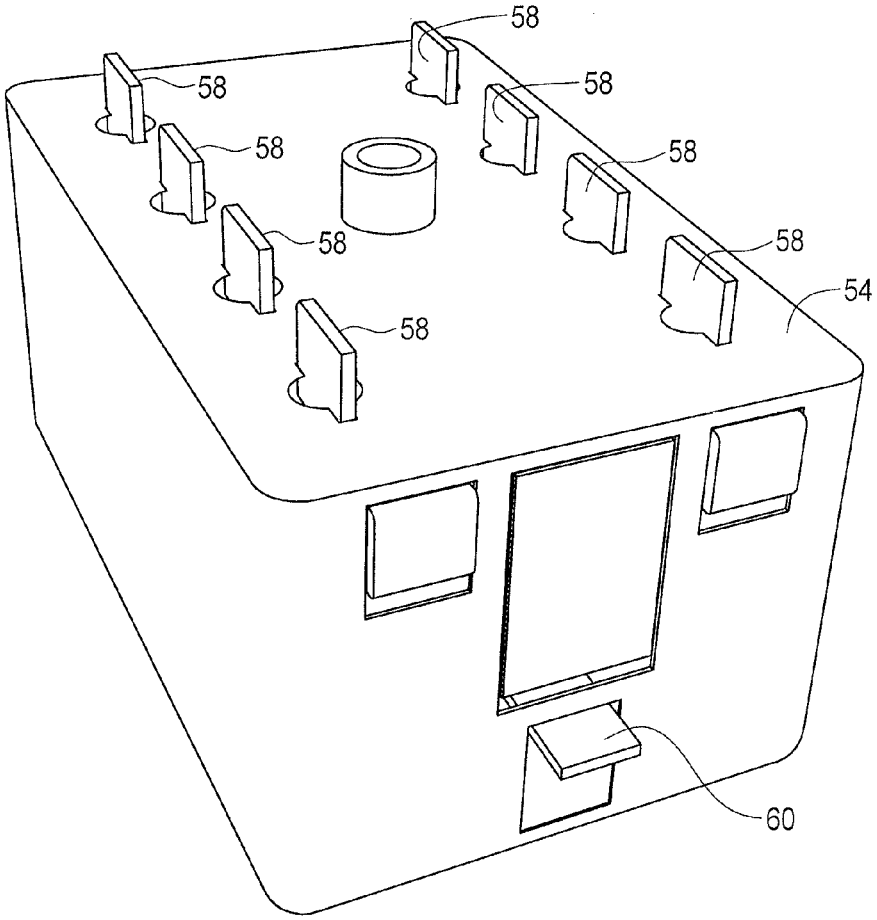
FIG. 4 is a perspective view of a portion of the mechanical arrangement of FIG. 1.

Mounted on the front plate 29 is a face plate 39 in which a plurality of pushbuttons 44-44 are spring-mounted. In the embodiment shown, there are a total of eight pushbuttons, numbered 1-8 in FIG. 1, although a different number of pushbuttons can be used. A rotatable knob 46 is mounted in faceplate 39, extending through front plate 29 and an intermediate plate 50 to engagement with activation element 40, which is attached to a biasing spring element 52. Attached to the rear of intermediate plate 50 is a lock combination member 54, shown generally in FIG. 4. Lock combination member 54 is held in place in the container by tabs 56 which extend rearwardly from plate 50 and an L-shaped plate 13, as well as other pin elements from plate 50 (not shown for clarity). Lock combination member 54 is shown representationally in FIG. 4, since a variety of such members can be used with the access assembly of FIG. 3. In the embodiment shown, lock combination assembly 54 includes a plurality of extending tab buttons 58-58 which are responsive to the operation of pushbuttons 44 (FIG. 3). The lock combination member is arranged so that when preselected pushbuttons are operated in a preselected sequence, an activating tab 60 extends from the lock combination assembly. In the embodiment shown, tab 60 will extend a selected additional distance for each correct button operated in the right sequence by the user. However, alternatives to this arrangement can be used. For instance, the activating tab 60 may extend fully when all of the preselected buttons have been operated in the right sequence.

Figure 5:
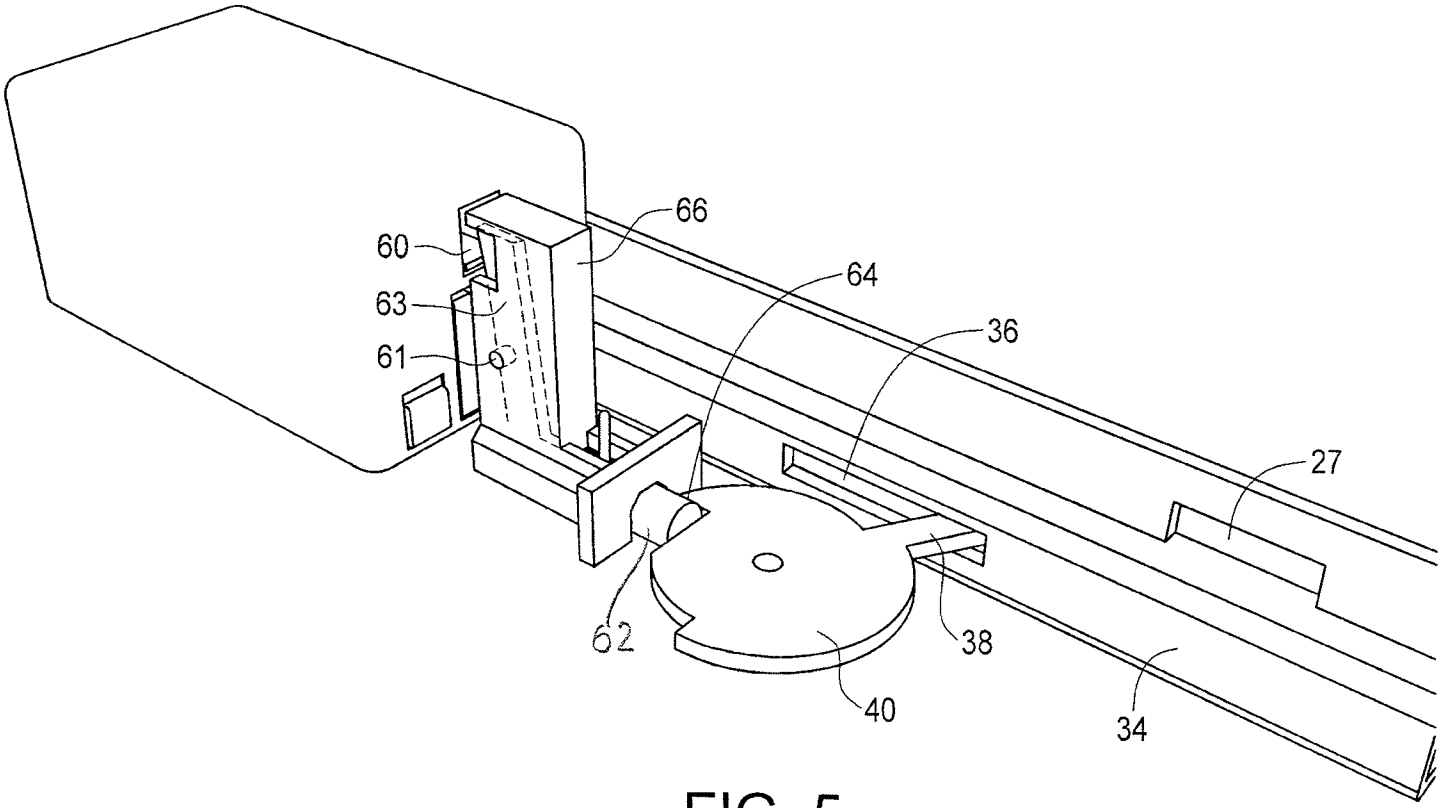
FIG. 5 is a perspective view of another portion of the mechanical arrangement of FIG. 1 in a locked position.
Figure 6:
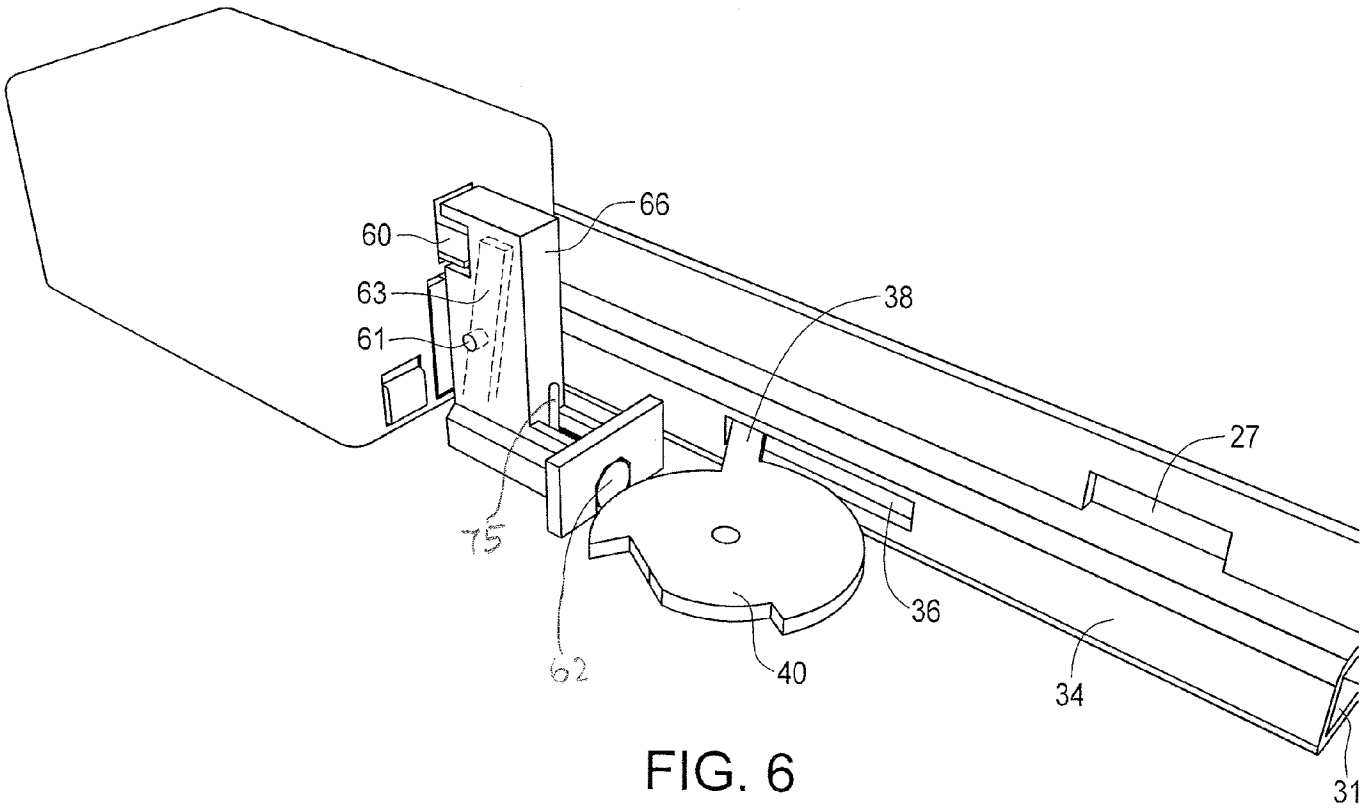
FIG. 6 is a perspective view of the portion of FIG. 5 in an unlocked position.

FIGS. 5 and 6 show the structure for linking the extending tab to a plunger 62 which is shown in its extended position in FIG. 5, mating with an indented edge 64 of activation element 40, maintaining it in a selected position against the action of spring 52. In this position, latching bar 24 cannot move and the latching elements stay latched to the latching bar, preventing the door from opening.

When the correct sequence of buttons is operated, tab 60 acts against a pivoting lever arm 63 positioned within a mounting housing 66. When tab 60 is fully extended, the lower end of the pivoting lever arm 63, which pivots about a pin 61, moves rearwardly, drawing the proximal end of the plunger to which it is attached away from engagement with the activation element, as shown in FIG. 6. In this position, the control knob 46 can rotate the activation element 40, including moving arm 38, which moves latching bar 24 sufficiently laterally that the latch elements no longer physically engage the latching bar. The door 14 can now be opened.

Still referring to FIG. 3, the mechanical access assembly also includes a key override member 68. A key (not shown) fits in the override member 68, which extends through openings in faceplate 50 and front plate 29. Rotating a key rotates a key tab 70 which rides in a curved portion 71 of an actuation plate 72. Rotating the key results in movement of the actuation plate, the distal end 74 of which contacts a pin 75 extending from plunger 62, moving plunger 62 away from actuation element 40, as shown in FIG. 6. The actuation element is thus free to be rotated against the action of the spring by the knob 46, moving the latching bar 24 such that the door latches are freed from the bar, permitting the door to be opened by the user. Use of the key bypasses the action of the lock combination assembly and link arm. Rotating the key back to the locked position locks the door.

The mechanical operation in summary uses a preselected sequence of pushbuttons operated by the user, through a mechanical linkage to withdraw a plunger from the actuation element, allowing the actuation element to be rotated against the bias of a spring by a user actuated knob 46. The access control can be bypassed by the use of a key override system.

FIGS. 2 and 7-9 show an electronic access assembly. The container 76 is basically the same as that for the mechanical access assembly of FIG. 1. The container 76 has a face plate 78 which is attached to a front plate 80 of the container. An L-shaped cover plate 81 covers the top and rear of the electronic access assembly, shown in exploded form in FIG. 7. The cover plate 81 includes two openings 82 and 83 through which door latches 84 and 85 extend. The cover 81 is attached to the container by screws 83.

The interior of the container 76 and container 10 for the mechanical access assembly could be adapted to house and support a shotgun, as for instance shown in U.S. patent application Ser. No. 12/832,628 the contents of which are included herein for reference, in addition to a handgun.

Figure 7:
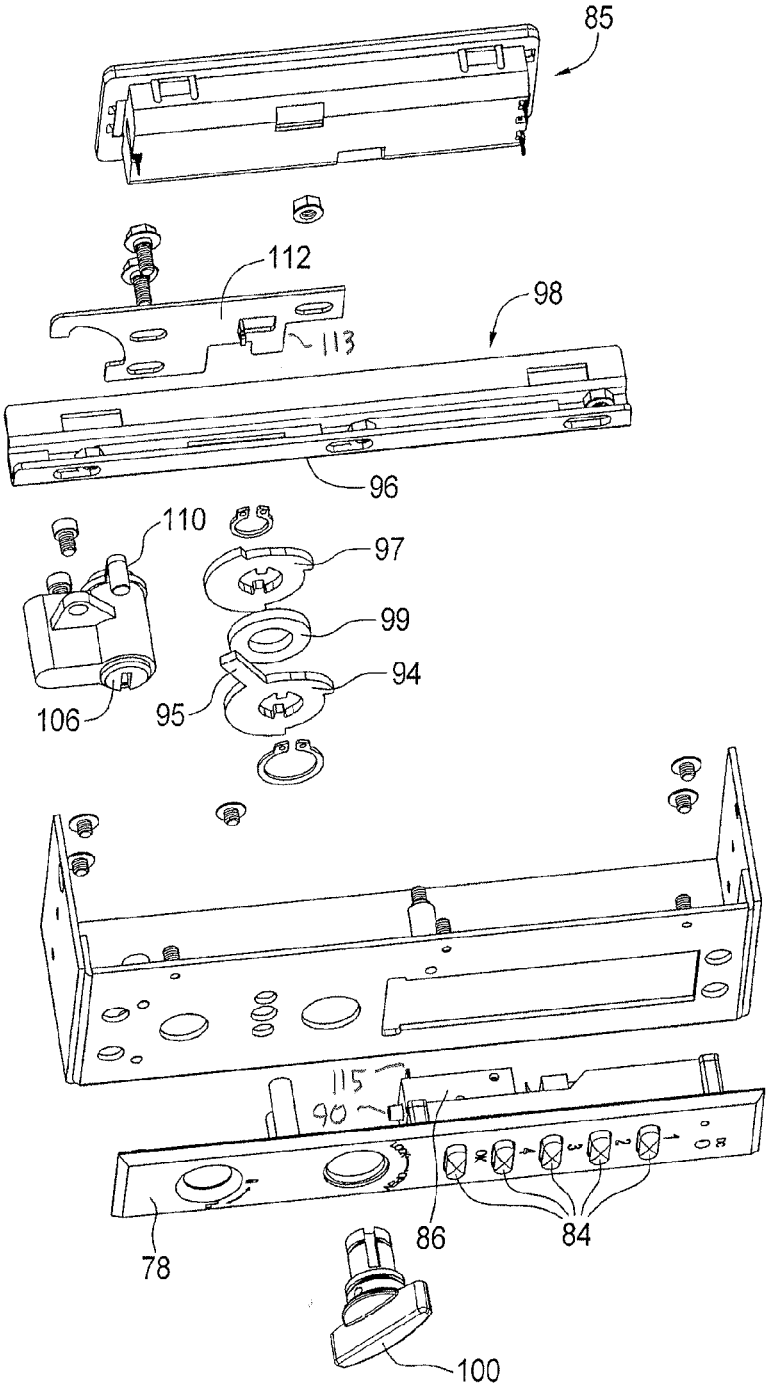
FIG. 7 is an exploded view of the electronic access assembly of FIG. 2.
Figure 8:
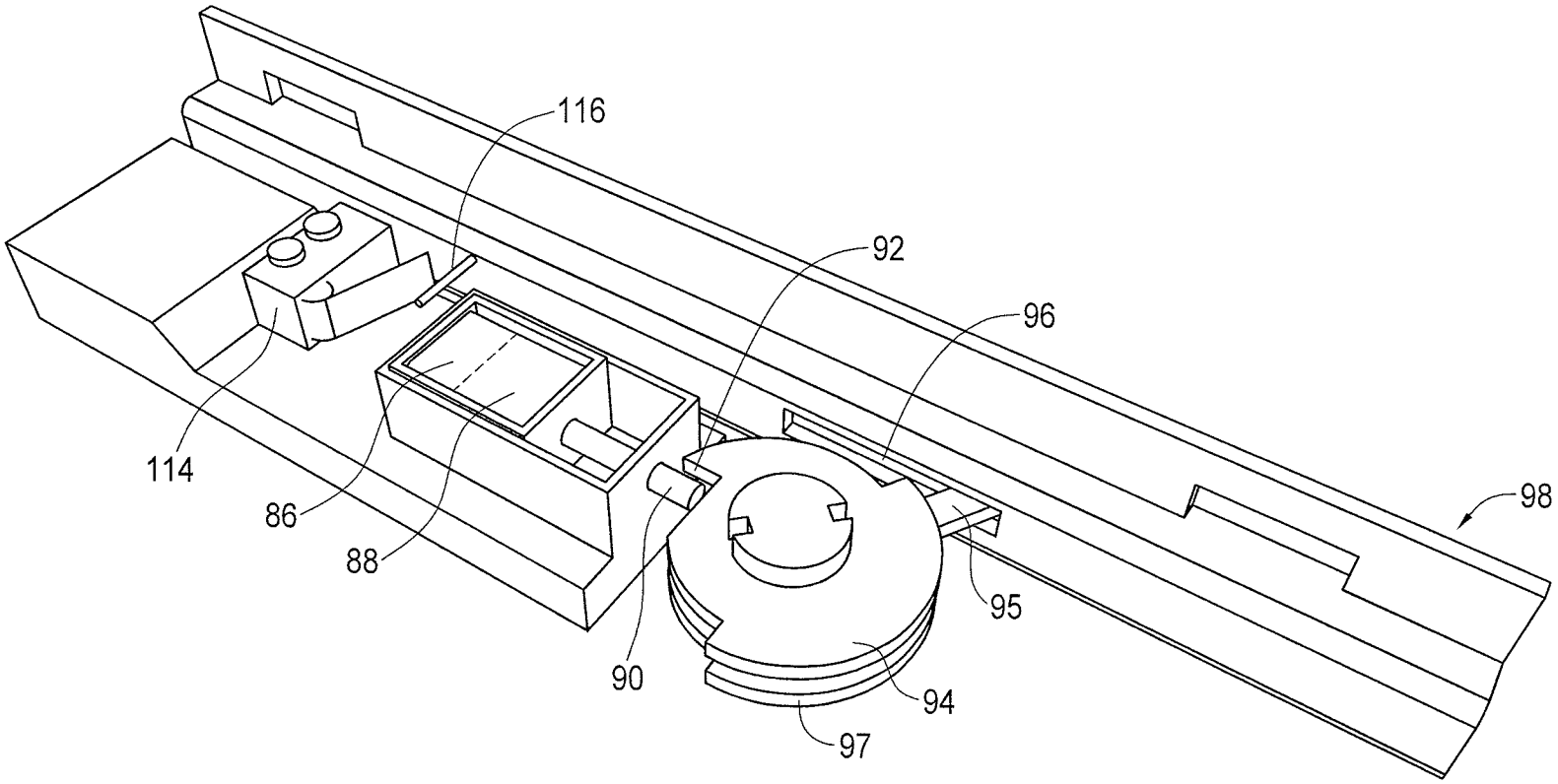
FIG. 8 is a perspective view of a portion of the electronic access assembly of FIG. 7, shown in a locked position.
Figure 9:
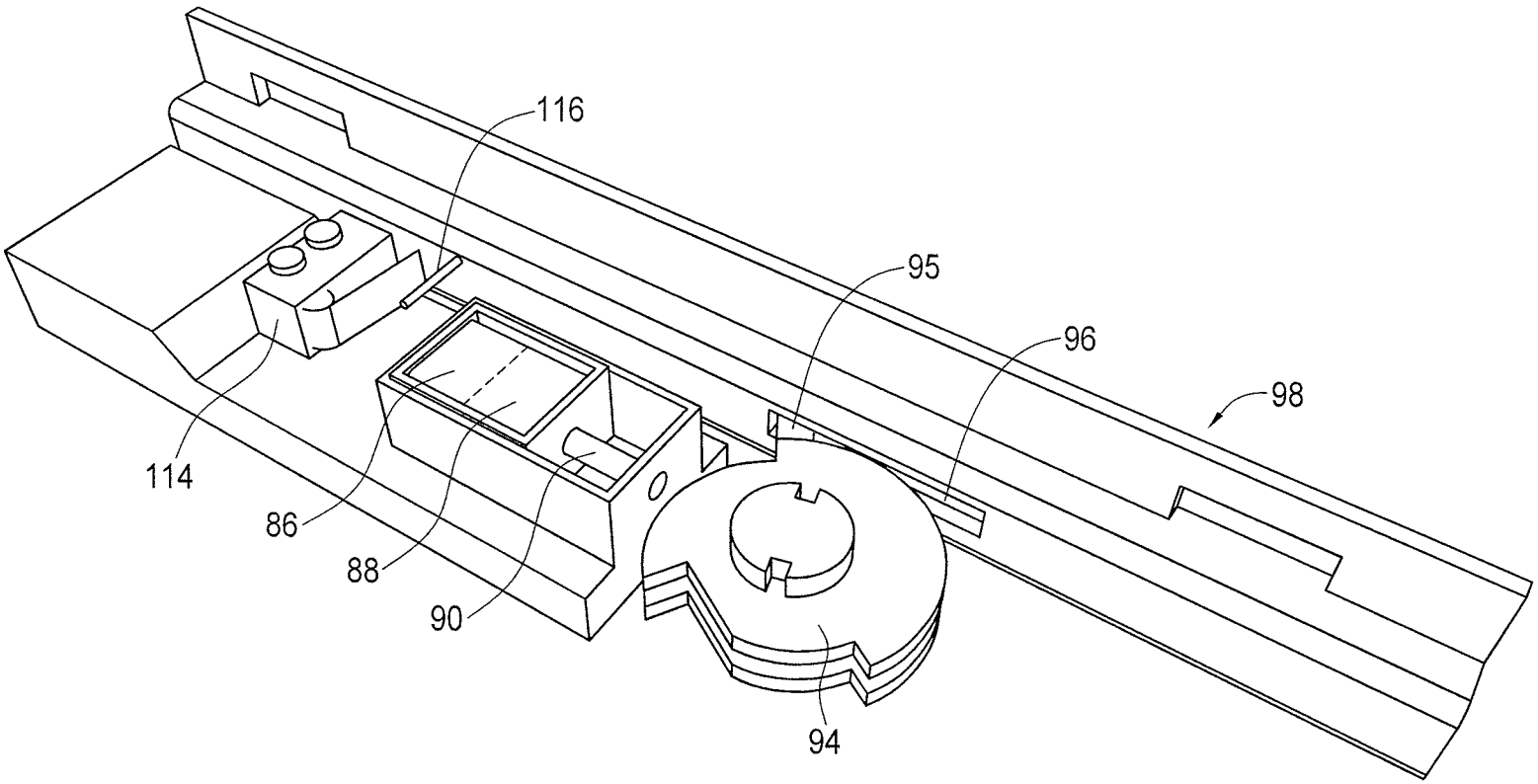
FIG. 9 is an exploded view of the electronic access assembly of FIG. 7, shown in an unlocked position.

Referring to FIGS. 7 and 8, the electronic access assembly is operated by a battery pack 85. In the embodiment shown, the electronic access assembly has a total of five pushbuttons 84-84. In the embodiment shown, the operation of pushbuttons 84 is read by a reader, shown generally at 86. When the reader determines a correct operation of buttons 84, an electromagnet 88, which controls a plunger 90, is activated. When the electronic access assembly is in its locked position, plunger 90 is in an extended position, engaging a cutout edge 92 of actuation element disc 94, which is similar to the actuation element in the mechanical embodiment. The actuation element includes an extended arm 95 which extends through slot 96 in latching bar 98, which also is identical to the latching bar in the mechanical arrangement. When the plunger is withdrawn, due to a correct actuation of the pushbuttons, knob 100, which engages actuation element 94 can rotate actuation element 94, which moves the latching bar 98 by arm 95, such that the latch elements from the container door are no longer engaged by the latching bar. The container door 100 can now be opened. The movement of latching bar 98 engages a reed switch 114 by a pin 116, which resets the locking mechanism. The electronic embodiment also includes a key override arrangement 104. The rotation of a key in the lock 106 rotates arm 110, sliding bracket 112 to engage plunger 90, by virtue of surface 113 engaging tab 115 on plunger 90, freeing the rotation of disc 97 which in turn rotates actuation element 94, allowing the door to open. Actuation elements 94 and 97 are separated by a spacer 99.

Accordingly, a firearm container has been described with a mechanical access assembly in one embodiment and an electronic access assembly in another embodiment. Both provide reliable and fast access to the firearm upon actuation of a selected sequence of pushbuttons on the front of the container.

Although a preferred embodiment of the invention has been disclosed for purposes of illustration, it should be understood that various changes, modifications and substitutions may be incorporated in the embodiment without departing from the spirit of the invention, which is defined by the claims which follow.

What is claimed is:

1. An apparatus for holding firearms, comprising:

a container which includes a body portion for holding a firearm and a door movably connected to the body portion, the door having at least one latching element; and a locking mechanism attached to the body portion, the locking mechanism including a latch bar having at least one latch opening to receive the latch element on the door in a connecting relationship; an actuation mechanism which in operation locks the latch bar relative to the latching element, preventing the door from opening; a plurality of actuating elements on the container for operation by a user; a lock combination member responsive to operation of the actuating elements to release the actuation mechanism, including a connecting assembly, which releases the actuation mechanism, the connecting assembly including a plunger operative to prevent the actuation mechanism from moving, the connecting assembly further including a member or assembly operative on the plunger to move the plunger away from the actuation mechanism when the preselected actuating elements are operated in a preselected sequence; and an operating member accessible to the user and connected to the actuation mechanism for moving the actuation mechanism when the actuation mechanism has been released, which in turn moves the latch bar sufficiently that the latch opening is so positioned that the latch element is free to move through the opening, allowing the door to be opened.

2. The apparatus of claim 1, wherein the lock combination member includes a tab member which extends from the responsive mechanism upon actuation of the preselected actuating elements in a preselected sequence, to operate the connecting assembly which releases the actuation mechanism.

3. The apparatus of claim 1, wherein the actuating elements are pushbuttons.

4. The apparatus of claim 1, wherein the actuation mechanism is a disc to which the operating member is operatively connected, wherein the disc includes an extending tab portion which fits into a slot in the latch bar, wherein moving the operating member rotates the actuation mechanism, moving the latch bar so that the door can be opened.

5. The apparatus of claim 1, wherein the operating member is a rotatable knob.

6. The apparatus of claim 1, including a key override mechanism which when operated by a key moves the connecting assembly away from the actuation mechanism, allowing the operating member to move the actuation mechanism and the latch bar sufficiently to allow the door to be opened.

7. The apparatus of claim 1, wherein operation of the actuating elements produces electrical signals and wherein the apparatus includes a reader for reading the electrical signals and when preselected actuating elements have been operated in a preselected sequence by a user, an electromagnet responsive to the reader withdraws a plunger from contact with the actuation mechanism, releasing the actuation mechanism so that the movement of the operating member by a user moves the latch bar to allow the door to be opened.

8. The apparatus of claim 7, wherein the operating element is a rotatable knob.

9. The apparatus of claim 7, including a key override which when operated by a key moves the plunger away from the actuation mechanism, allowing the operating element to move the actuation mechanism and the latch bar sufficiently to allow the door to be opened.

* * * * *